US010094639B2

(12) United States Patent
Sessions et al.

(10) Patent No.: US 10,094,639 B2
(45) Date of Patent: Oct. 9, 2018

(54) ACCESSORY MOUNT FOR A FIREARM AND RELATED METHODS

(71) Applicant: Magpul Industries Corp., Austin, TX (US)

(72) Inventors: Turner Sessions, Lafayette, CO (US); Grady Barfoot, Denver, CO (US); William Bradley Bennett, Lafayette, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/581,906

(22) Filed: Apr. 28, 2017

(65) Prior Publication Data

US 2018/0003465 A1 Jan. 4, 2018

Related U.S. Application Data

(60) Provisional application No. 62/357,245, filed on Jun. 30, 2016.

(51) Int. Cl.

| | |
|---|---|
| ***F41G 11/00*** | (2006.01) |
| ***F41A 11/02*** | (2006.01) |
| *F41C 23/16* | (2006.01) |

(52) U.S. Cl.

CPC ..... *F41G 11/003* (2013.01); *F41A 11/02* (2013.01); *F41C 23/16* (2013.01); *F41G 11/001* (2013.01)

(58) Field of Classification Search

CPC ..... F41G 11/003; F41G 11/001; F41A 11/02; F41C 23/16

USPC ..... 42/124, 90, 127

See application file for complete search history.

(56) References Cited

U.S. PATENT DOCUMENTS

| | | | | |
|---|---|---|---|---|
| 3,579,840 | A * | 5/1971 | Heinzel | F41G 11/003 42/127 |
| 5,918,374 | A | 7/1999 | Campbell et al. | |
| 6,381,895 | B1 | 5/2002 | Keeney et al. | |
| 7,302,881 | B1 * | 12/2007 | Tertin | F41A 11/02 42/69.02 |
| 8,397,421 | B2 * | 3/2013 | Ding | F41G 11/003 42/124 |
| 8,978,287 | B1 | 3/2015 | Riley | |
| 9,574,840 | B1 * | 2/2017 | Sisk | F41C 23/16 |

(Continued)

FOREIGN PATENT DOCUMENTS

DE 202009001575 U1 9/2009

OTHER PUBLICATIONS

PMACA 10/22 Takedown Chassis; https://web.archive.org/web/20160807081331/http://www.pmacamfg.com:80/collections/stock-adapters/products/pmaca-10-22-ruger-takedown-chassis; Aug. 7, 2016 (Year: 2016).*

Brownells, Inc., "Ruger 10/22 Scope Mount Ruger", "Retrieved from http://www.brownells.com/search/index.htm?k=ruger+10%2f22+scope+mount+ruger&ksubmit=y", May 11, 2016, p. 3.

(Continued)

*Primary Examiner* — Joshua E Freeman

(74) *Attorney, Agent, or Firm* — Neugeboren O'Dowd PC

(57) ABSTRACT

A firearm accessory mount for a take-down rifle is disclosed. The mount has a first portion having an accessory interface, and a second portion opposing the first portion. The second portion has a locking block with a proximal end and a distal end. The proximal end is shaped and positioned to engage a receiver assembly of the take-down rifle. At least one of the first portion or the second portion has a barrel engagement surface. A related method is also disclosed.

29 Claims, 19 Drawing Sheets

(56) References Cited

U.S. PATENT DOCUMENTS

| | | | | |
|---|---|---|---|---|
| 2009/0077855 | A1* | 3/2009 | Pritchett | F41G 11/003 42/90 |
| 2010/0154280 | A1* | 6/2010 | LaFrance | F41G 11/001 42/124 |
| 2010/0162605 | A1* | 7/2010 | Laney | F41A 3/24 42/25 |
| 2010/0281742 | A1* | 11/2010 | Barrett | F41A 11/04 42/75.02 |
| 2011/0094136 | A1* | 4/2011 | Zimmerman | B21C 23/14 42/6 |
| 2012/0167437 | A1* | 7/2012 | Holmberg | A01K 89/08 42/90 |
| 2012/0311910 | A1* | 12/2012 | Mironichev | F41C 23/10 42/90 |
| 2013/0180145 | A1* | 7/2013 | Behling | F41A 3/66 42/16 |
| 2014/0190062 | A1* | 7/2014 | Turner, Jr. | F41G 11/003 42/124 |
| 2014/0373420 | A1* | 12/2014 | Harris | F41G 11/003 42/84 |
| 2015/0013203 | A1* | 1/2015 | Lopiccolo | F41C 23/04 42/73 |

OTHER PUBLICATIONS

Volquartsen Firearms, "Barrel Mounted Scope Mount for Ruger 10/22", "Retrieved from https://www.volquartsen.com/products/160-barrel-mounted-scope-mount-for-ruger-10-22", Jun. 30, 2016, p. 3.

Volquartsen Firearms, "Lightweight Barrel and Stock for Ruger 10/22 Takedown", "Retrieved from https://www.volquartsen.com/products/1198-lightweight-barrel-and-stock-for-ruger-10-22-takedown", Jun. 30, 2016, p. 3.

Brownells, Inc., "XS Sight Systems—Ruger Scout Rifle Rail", "Retrieved from http://www.brownells.com/optics-mounting/rings-mounts-amp-bases/rifle-bases/ruger-scout-rifle-rail-prod44897.aspx", May 11, 2016, p. 2.

Magnum Wheel Man, "Looking for a Barrel Mount Scope Base for Take Down 10-22", "Retrieved from http://rugerforum.net/optics/88730-looking-barrel-mount-scope-base-take-down-10-22", Sep. 23, 2013, p. 5.

Brownells, Inc., "Scout", "Retrieved from http://www.brownells.com/search/index.htm?k=scout&ksubmit=y", May 11, 2016, p. 6.

Optics Planet, "Taurus Blue Scope Mount for Model 62/72/172 Rifle 10040", "Retrieved from http://www.opticsplanent.com/taurus-blue-scope-mount-for-model-62-72 . . . ", May 11, 2016, p. 3.

Volquartsen Firearms, "Volquartsen Firearms", "Retrieved from https://www.volquartsen.com/", Jun. 30, 2016, p. 2.

* cited by examiner

ACCESSORY MOUNT FOR A FIREARM AND RELATED METHODS

CROSS-REFERENCE TO RELATED APPLICATIONS

This application claims priority to U.S. Provisional Application No. 62/357,245 filed on Jun. 30, 2016 and entitled "ACCESSORY MOUNT FOR A FIREARM AND RELATED METHODS," the entire disclosure of which is hereby incorporated by reference for all proper purposes.

FIELD

The present disclosure relates to firearms. In particular, but not by way of limitation, the present disclosure relates to systems and methods for mounting an optic to a firearm.

BACKGROUND

Historically, iron sights have been mounted to barrels, so as to provide a means for aiming the firearm. Iron sights continue to be a reliable, light-weight, and low cost method. More recently, however, optical sights and mounts have become more common in the industry, with most after-market scopes being mounted to receivers because the scope is held closer to the eye, and, typically, there is no need for the additional complexity or weight of a cantilever. Forward mounted (long eye-relief) scopes are also available, such as unity power red dot scopes, and are particularly suited for some fixed-barrel rifle applications.

However, take-down or break-down rifles, such as certain models of the Ruger 10/22 or others, typically exhibit more tolerance stack-up and/or relative movement between the receiver and the barrel than do fixed barrel rifles, due to the take-down feature itself, thus requiring more time and effort to properly sight in and/or exhibiting changes over time (for example, due to variations in temperature, components loosening after use, etc.). In some cases, after market barrels may be attached, or existing barrels may be modified by a gunsmith so as to provide a fastening feature in the barrel itself, to which a scope mount may be attached.

Similarly, some systems, such as the Steyr AUG, have what are commonly referred to as "quick change" barrels. These systems readily reconfigurable with different length barrels, so as to function as a light support weapon, rifle, carbine, or submachinegun, and different calibers (with other associated parts swapped). These are really takedown rifles even though they are not typically recognized as such, and may have some challenges similar to those previously described above.

Although these arrangements are generally functional, there remains a need for a reliable and accurate no-gunsmithing means for attaching an after-market accessory or scope to a barrel for a take-down rifle or other weapons.

SUMMARY

An exemplary firearm accessory mount for a take-down rifle is described. The exemplary mount has a first portion having an accessory interface, and a second portion opposing the first portion. The second portion has a locking block with a proximal end and a distal end, the proximal end shaped and positioned to engage a receiver assembly of the take-down rifle. At least one of the first portion or the second portion has a barrel engagement surface.

An exemplary method of attaching a firearm accessory mount to a take-down rifle includes providing a mount, the mount having a first portion having an accessory interface, and a second portion opposing the first portion, the second portion having a locking block with a proximal end and a distal end, the proximal end shaped and positioned to engage a receiver assembly of the take-down rifle, wherein at least one of the first portion or the second portion has a barrel engagement surface. The method also includes positioning the first portion partially about a barrel of the take-down rifle. The method also includes positioning the second portion partially about the barrel.

DETAILED DESCRIPTION

Before describing in detail the features of an accessory or scope mount and method disclosed herein, a high level introduction may be useful. As previously mentioned herein, take-down rifles may, by their very nature, exhibit a level of movement between the receiver and the barrel that is not exhibited in typical fixed barrel rifles. Therefore, scope mounts provided on the receiver of take-down rifles may require repeated zeroing or sighting in, and/or more time to properly zero or sight in, as compared to other rifles. As will be described herein, Applicants provide in some embodiments a new and innovative scope mount that allows users to use no-gunsmithing means and methods to attach an after-market scope mount to the barrel of the rifle, while maintaining an excellent level of sighting accuracy.

For the purpose of this document, the term "no-gunsmithing" shall be understood to mean "no-machining". For example, disassembling or reassembling a firearm is not considered "gunsmithing" for the purpose of this document; in contrast, machining the barrel of a firearm is considered "gunsmithing" for the purpose of this document.

Figure 14:
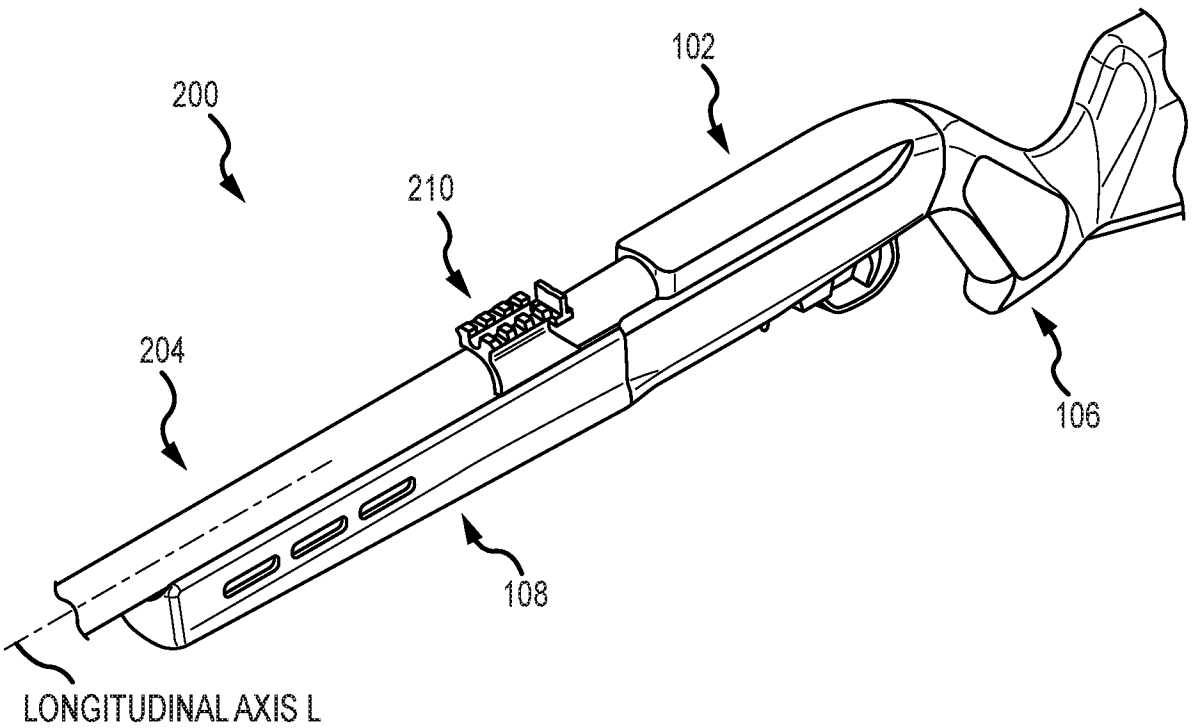
FIG. 14 is a perspective view of an exemplary mount on a take-down rifle having a bull barrel.
Figure 15:
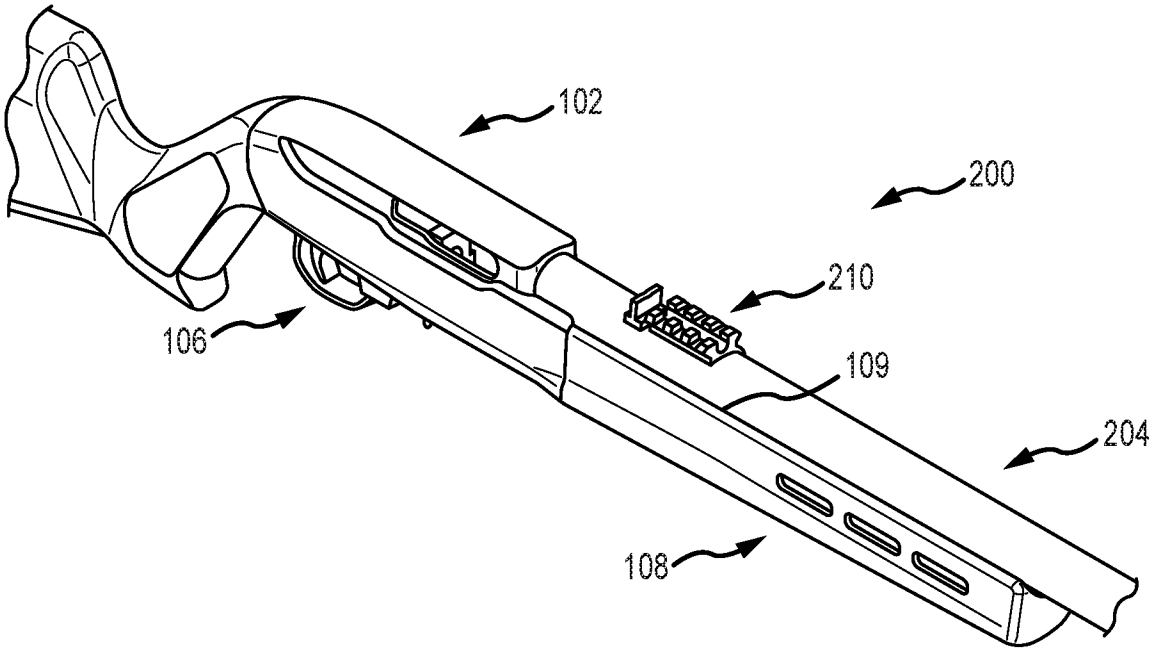
FIG. 15 is another perspective view of the assembly in FIG. 14.

Referring now to the drawings, where like or similar elements are designated with identical reference numerals throughout the several views, and referring in particular to FIG. 1, and FIGS. 1-13 generally, shown is a take-down firearm assembly 100 having a receiver 102, a barrel 104 removably coupled to the receiver 102 (see e.g. FIG. 4), a firearm stock 106 removably coupled to the receiver 102, and a forend assembly 108 removably coupled to the stock 106. Of note, the firearm assembly 100 illustrated in FIGS. 1-4 is identical to the firearm assembly 200 illustrated in FIGS. 14-15, but with a tapered barrel 104 or a straight barrel 204 respectively. Those skilled in the art will recognize that 10/22 rifles may be interoperable with a number of barrel sizes and shapes.

Figure 1:
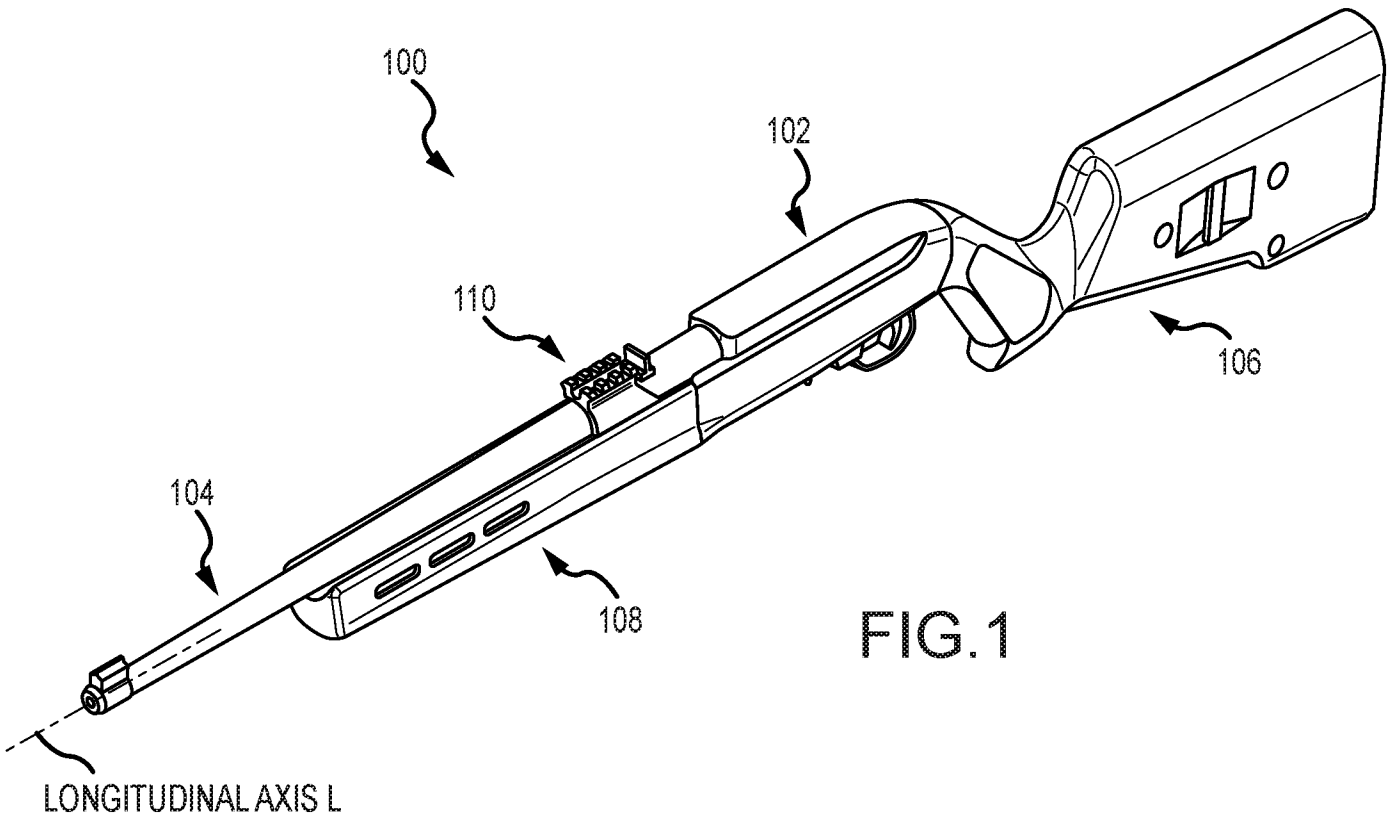
FIG. 1 is a perspective view of a take-down rifle with an exemplary mount.
Figure 2:
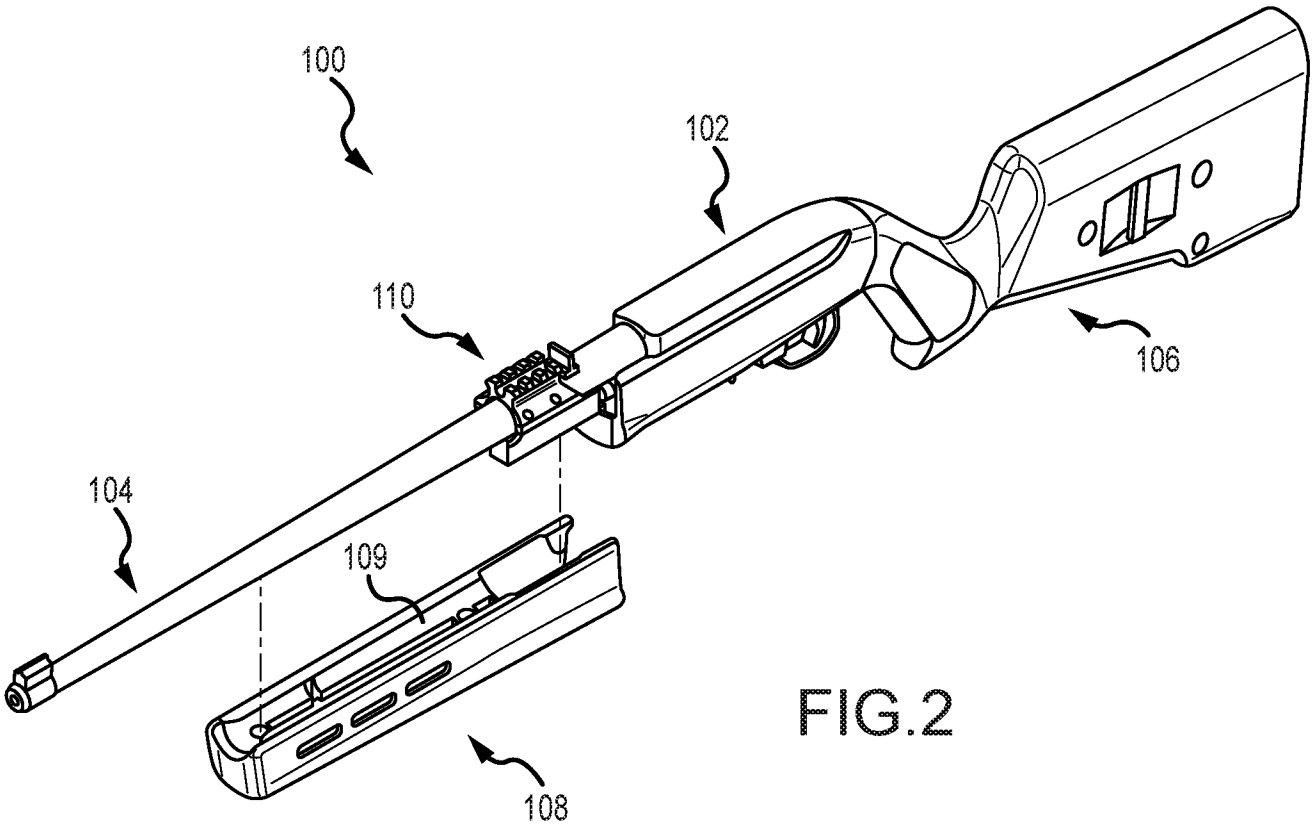
FIG. 2 is a perspective partially exploded view of the assembly in FIG. 1.

Continuing with FIG. 1, an accessory mount 110 is also illustrated, and may be removably coupled to the barrel 104. Of note, the accessory mount 110, 210 (see also FIG. 14) described herein may be configured for operability with only one or more than one barrel type.

Figure 5:
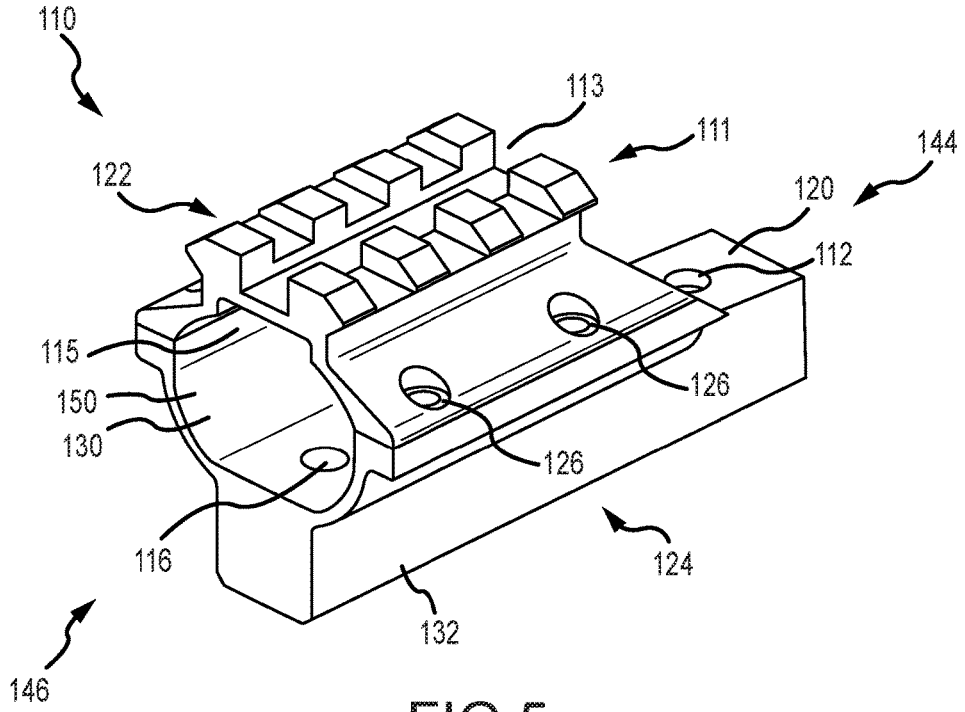
FIG. 5 is a perspective view of the mount in FIG. 1.

Turning now to FIG. 5, the accessory mount 110 may have an accessory interface 111, such as a Picatinny rail as illustrated, or any other accessory mount, such as any standardized scope interface now known or as yet to be developed, an M-LOK or other proprietary or free license modular mounting system, or a mounting system for a laser sight, a flashlight, optical sights, backup iron sights and/or other accessories.

Figure 3:
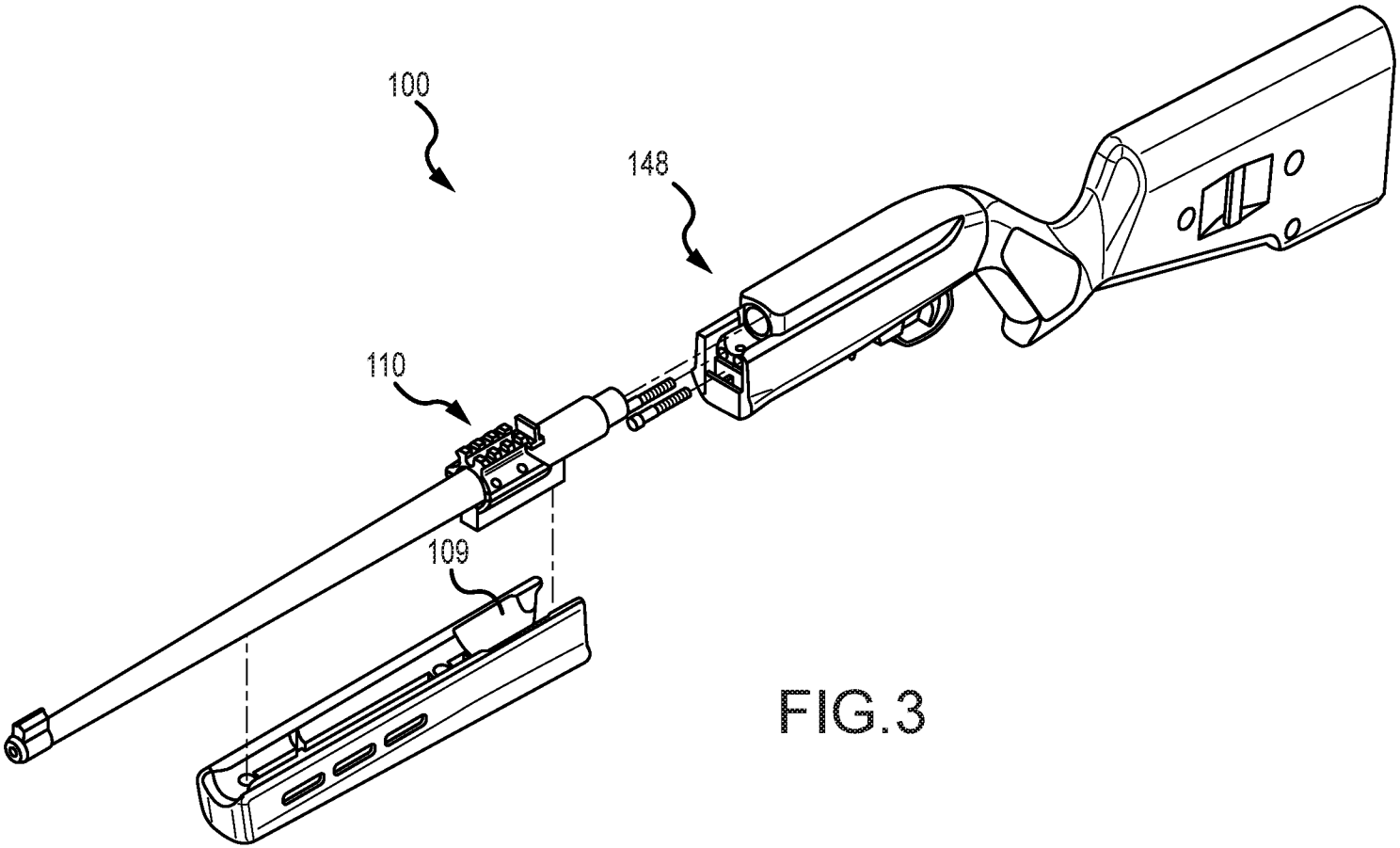
FIG. 3 is a perspective exploded view of the assembly in FIG. 1.
Figure 4:
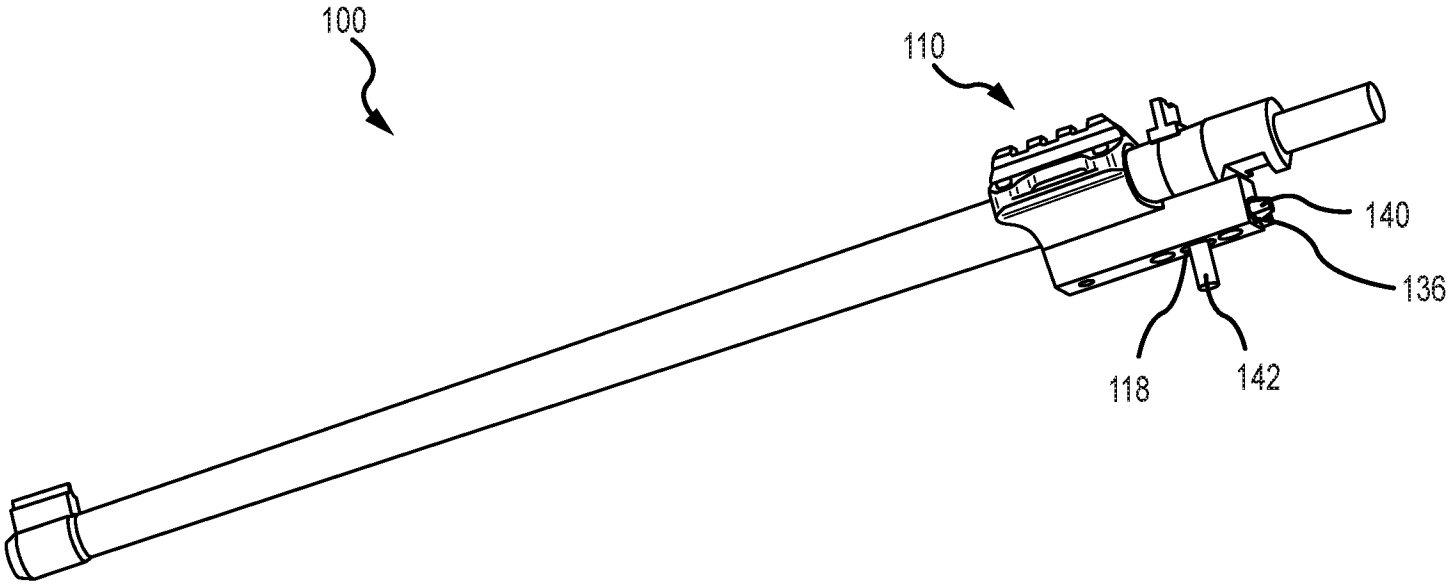
FIG. 4 is another perspective view some components of the assembly in FIG. 1.
Figure 16:
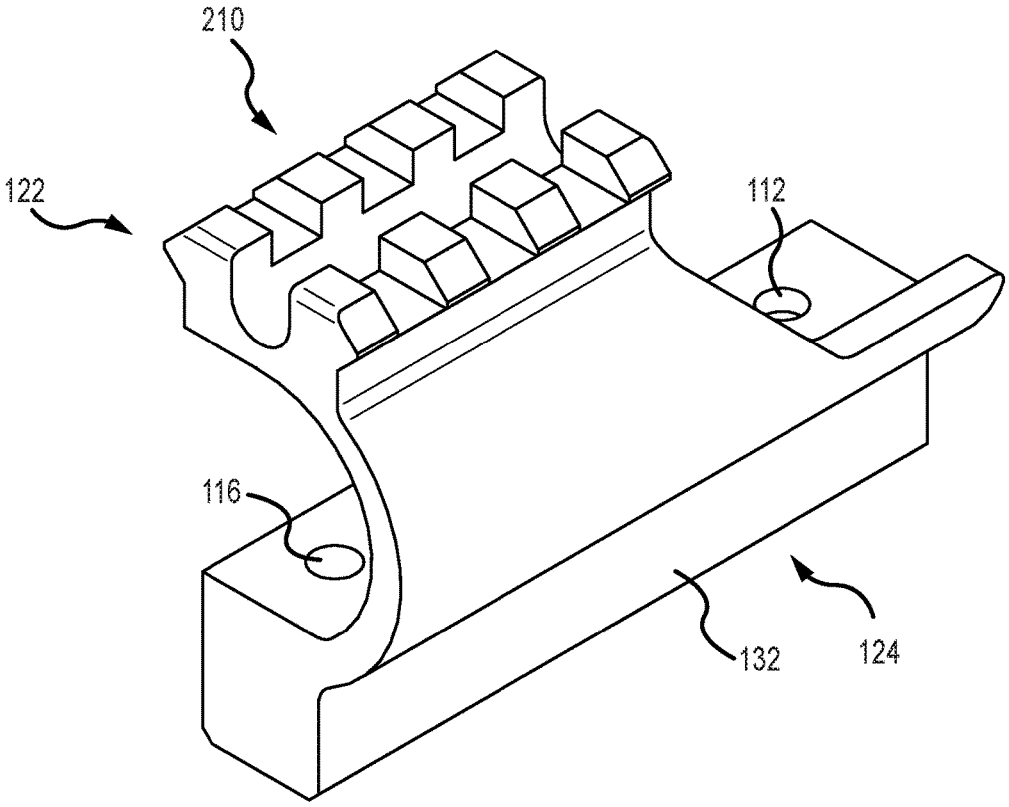
FIG. 16 a perspective view of the mount in FIG. 14.

Continuing with FIG. 5, the accessory mount 110 may be a no-gunsmithing firearm accessory mount for a take-down rifle. The mount 110 may have a first portion 122 having an accessory interface 111, and a second portion 124 opposing the first portion 122. The second portion may have a locking block 132, or block 132 for short, with a proximal end 144 and a distal end 146, the proximal end 144 shaped and positioned to engage a receiver assembly 148 of the take-down rifle 144. At least one of the first portion 122 or the second portion 124 has a barrel engagement surface 120, 150. That is, a portion of one or both the first or second portions 122, 124 may abut the barrel. The barrel engagement surface 120 may be referenced herein as a support surface 120. For the purpose of this document, a receiver assembly 148 shall be understood to mean that portion of a rifle that remains when a barrel assembly is removed from a take-down rifle, as illustrated in FIG. 3. The receiver assembly 148 may include the receiver and other components. In some embodiments, the first portion 122 may be removably coupled to the second portion 124 as illustrate in FIG. 5; however, those skilled in the art will recognize that the first portion 122 and second portion 124 may be unitary, as illustrated in FIG. 16. Those skilled in the art will also recognize that the first and second portions 122, 124 may be unitary and encircle the barrel, or adjustable relative to each other.

Figure 5A:
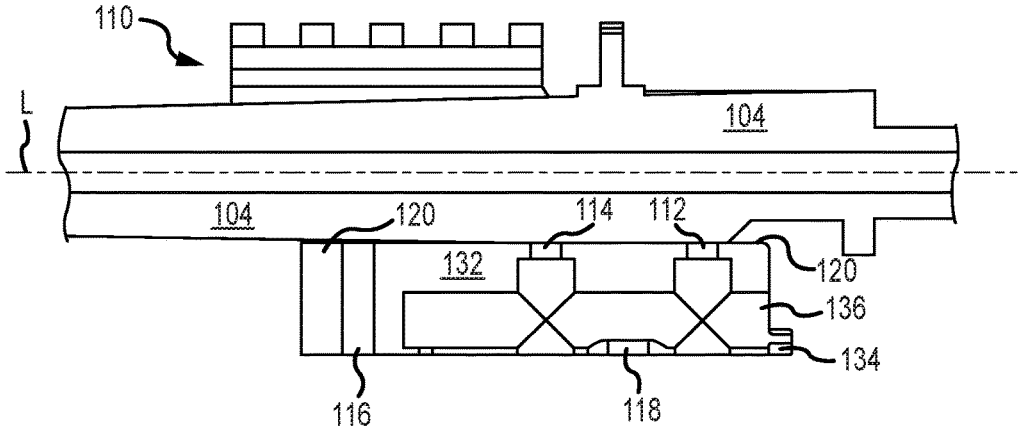
FIG. 5A is a side section view of the mount in FIG. 1 on a barrel.

The accessory mount 110 may also have a recess 130 or passage for receiving or at least partially encircling a barrel 104 of a firearm, as well as a barrel support surface 120 for abutting the barrel 104 and/or aligning the accessory mount 110 with the barrel 104. Where the firearm has a tapered barrel 104, the support surface 120 or a portion of the barrel support surface 120 may be appropriately angled relative to the longitudinal axis L, and/or the barrel support surface 120 may be angled relative to and curved relative to the longitudinal axis L. Those skilled in the art will recognize, however, that, even where the barrel 104 is tapered, a support surface 120 that is flat and/or parallel to the longitudinal axis L may be used, as illustrated in FIG. 5A. That is, in some embodiments, even where the firearm 100 has a tapered barrel 104, the accessory mount 110 may have a support surface 120 that is parallel to the longitudinal axis L, so as to engage an interface on the barrel 104 that is also parallel to the longitudinal axis L; for example, in some cases, the firearm 100 may have a tapered barrel 104 and an interface parallel with the longitudinal axis L. In some embodiments, the support surface 120 may be angled relative to the longitudinal axis L to engage an angled or tapered interface on a straight or bull barrel 204. The longitudinal axis L, also known as the bore axis to those skilled in the art, may be defined by a firing direction of the rifle 100, 200. Those skilled in the art will understand that the barrel support surface 120 may or may not extend the entire longitudinal length of the accessory mount 110.

Figure 17:
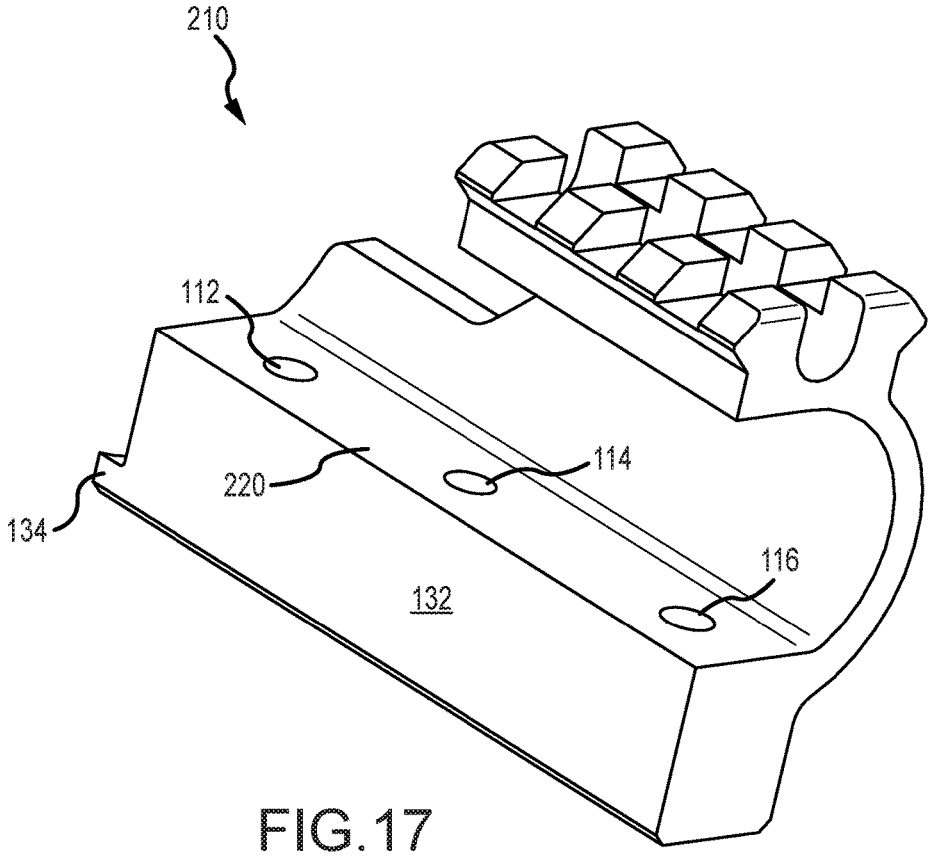
FIG. 17 is a perspective view of the mount in FIG. 14.

Those skilled in the art will also understand that, in some embodiments, or where the barrel 204 is a straight or bull barrel, the support surface 220 (see e.g. FIGS. 14, 17) may be substantially parallel to the longitudinal axis L, and may be substantially planar or curved relative to the barrel 204 or longitudinal axis L.

Those skilled in the art will readily recognize that the support surface 120, 220 may be a raised, recessed, angled, rounded, or flat surface that is shaped to abut the barrel 104, 204 at a predetermined location and/or to apply a compressive force about the barrel 104, 204, in coordination with an opposing surface of the recess 130, so as to introduce additional rigidity to the firearm assembly 100, 200.

Figure 16A:
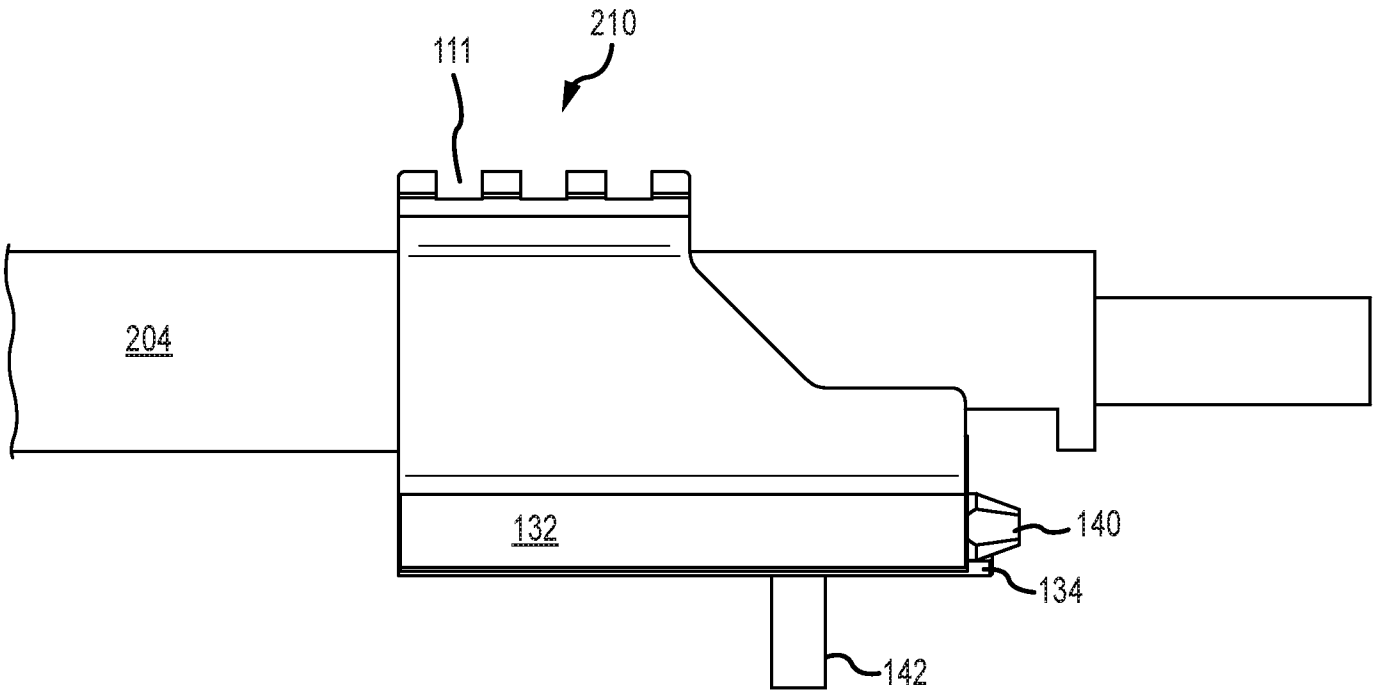
FIG. 16A is a side view of the mount and barrel in FIG. 14.
Figure 19:
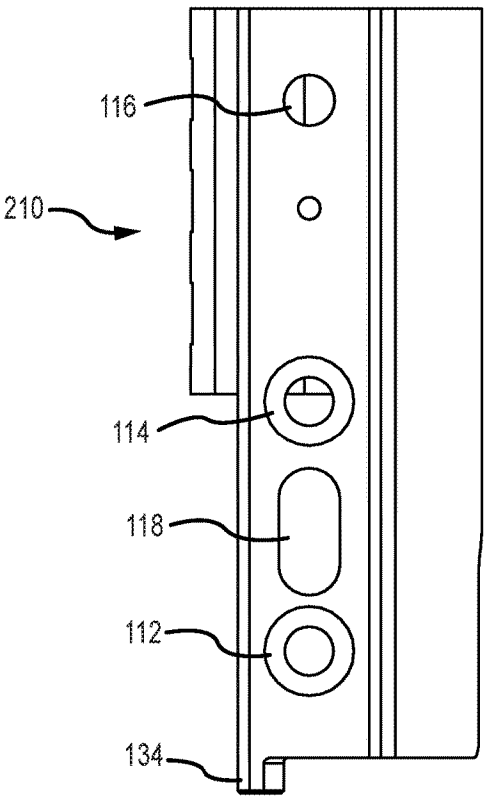
FIG. 19 is a bottom view of the mount in FIG. 14.
Figure 18:
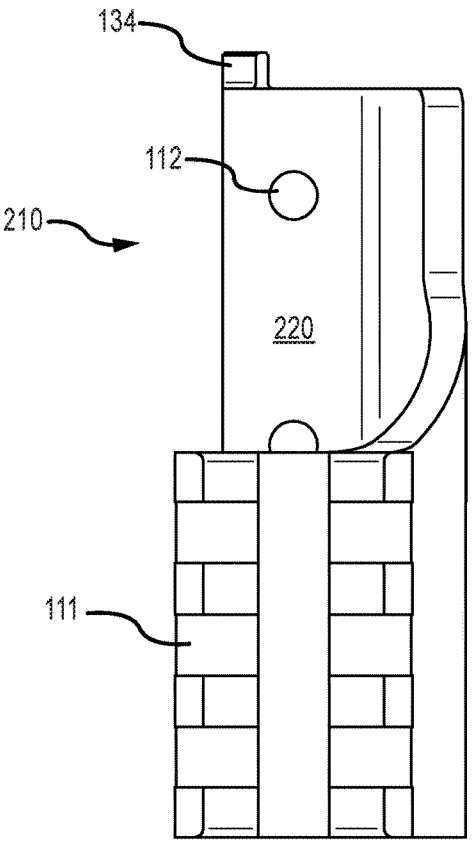
FIG. 18 is a top view of the mount in FIG. 14.
Figure 20:
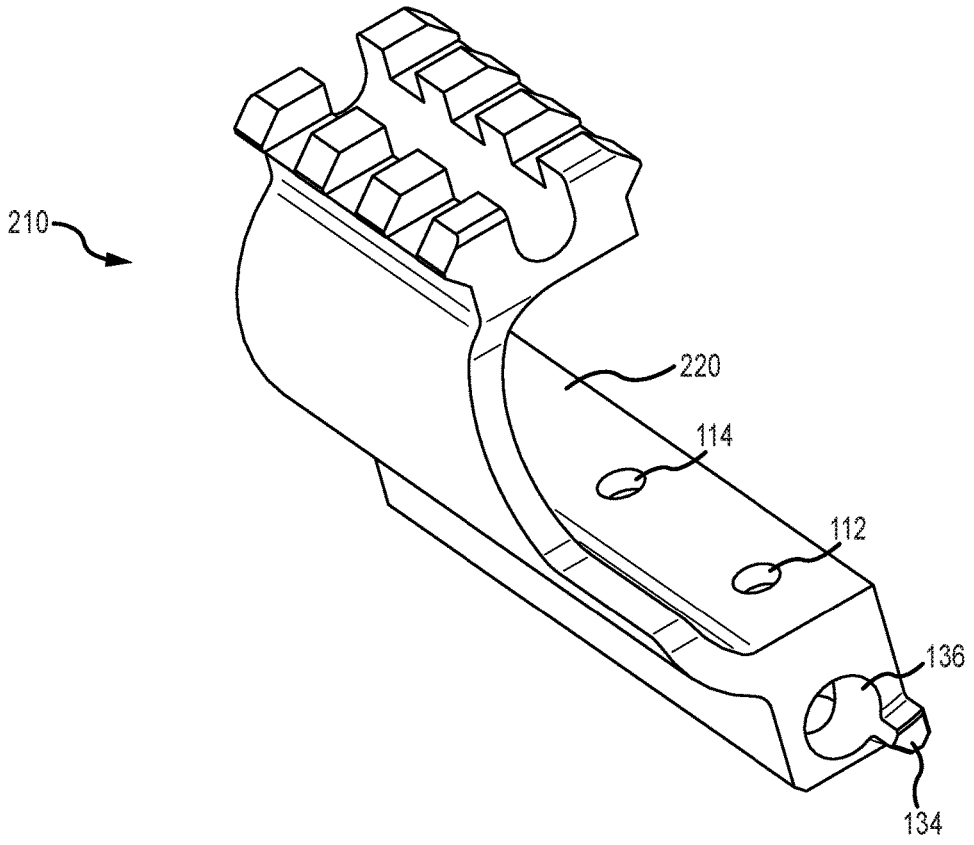
FIG. 20 is a perspective view of the mount in FIG. 14.
Figure 21:
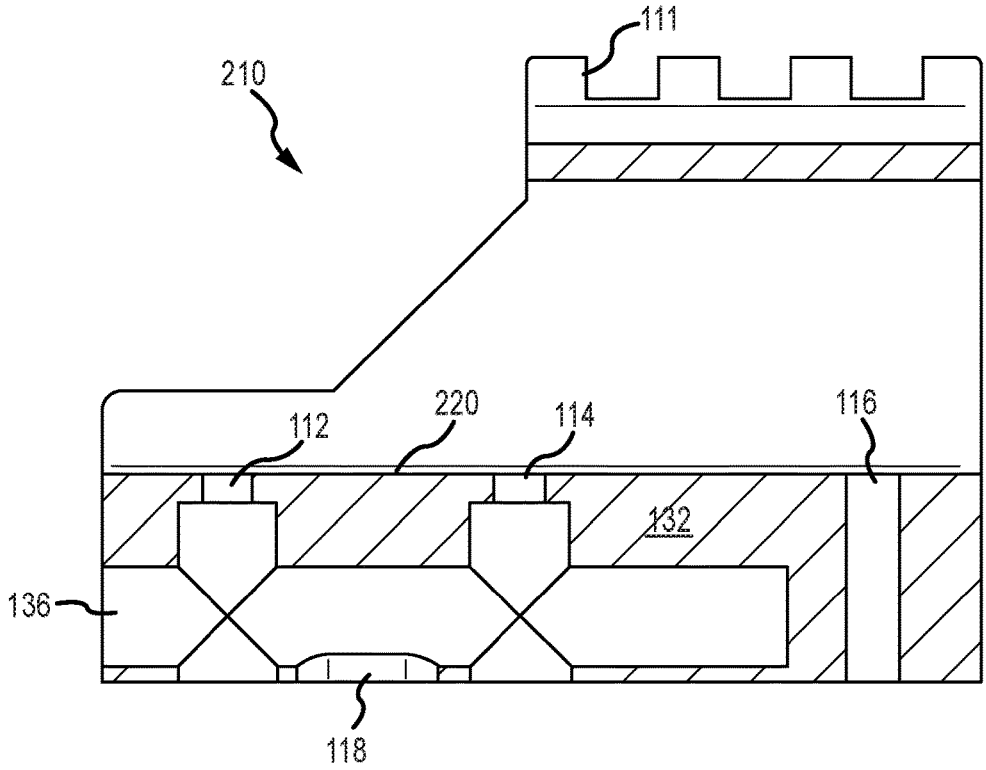
FIG. 21 is a side section view of the mount in FIG. 14.

With reference to FIGS. 5A, 16A, and 21, the accessory mount 110, 210 may include a block 132 with a first recess 136 for receiving a locking plunger 140 (see FIG. 16A) and a second recess 118 for receiving a locking lever 142. The block 132 may also have a tab 134 (see e.g. FIGS. 6, 19) to assist in aligning the accessory mount 110, 210 with the receiver 102, in a manner similar to that known in relation to currently-available locking blocks. Those skilled in the art will recognize that the locking lever 142 is generally a tab that may extend downward, and is movable longitudinally to allow a user to manipulate the locking plunger 140 during attachment and removal of the barrel 104, 204, in a manner commonly known in the industry. In some embodiments, the accessory mount 110, 210 may include the block 132, the locking plunger 140, and/or the locking lever 142 (see e.g. FIG. 16A). In some embodiments, the accessory mount 110, 210 may include components making up a lockup mechanism or replacing a lockup function of OEM 10/22 take-down rifles.

That is, the accessory mount 110, 210 may be integrated into a lockup mechanism (those components that lock the barrel 104, 204 to the receiver 102) for a detachable barrel 104, 204. The first recess 136 may have a longitudinal depth that is greater than a width, while the second recess 118 may include a passage into the first recess 136 as is known in currently-available lockup mechanisms for take-down rifles. The second recess 118 may be transverse relative to the first recess 136.

The accessory mount 110, 210 may also have a recess 116 or passage for receiving a fastener (not illustrated) to couple a forend 108 to the accessory mount 110, 210.

Returning now to FIG. 5, the accessory mount 110 may have a first portion 122 removably coupled to a second portion 124 to form the recess 130 or passage therebetween.

The second portion 124 may be shaped to provide a lockup function between the accessory mount 110 and the receiver 102 as previously described herein.

In some embodiments, the first portion 122 and second portion 124 may be coupled together at one or more fastening points 126, before or after the rest of the accessory mount 110 is attached to the assembly 100. The fastening points 126 may include threaded recesses or passages for receiving one or more threaded fasteners (not illustrated). That is, in some embodiments, the first and second portions 122, 124 may be coupled together about the barrel 104 after the barrel 104 is attached to the receiver 102, or, in some embodiments, the first and second portions 122, 124 may be coupled together prior to attaching the accessory mount 110 to the barrel 104.

As illustrated most clearly in FIG. 5A and FIG. 21, the accessory mount 110, 210 may have one or more recesses 112, 114 for receiving fasteners (not illustrated) to couple the accessory mount 110 to the barrel 104. In some embodiments, the recesses 112, 114 and fasteners (not illustrated) allow for adjustment of the accessory mount 110 relative to the barrel 104, such as for aligning the accessory mount 110, 210.

In some embodiments, the accessory mount 110, 210 is shaped to maintain an air gap between the barrel 104, 204 and most portions of the accessory mount 110, 210. In some embodiments, the block 132 may act as a heat sink for the regions of the accessory mount 110, 210 that do contact the barrel 104, 204. In some embodiments, the overall height of the accessory interface 111 may be selected so as to allow for mounting the accessory mount 110, 210 and/or sighting in using the factory iron sights. A groove 113 in the accessory interface 111 (such as a groove in an otherwise standard Picatinny rail) may be provided to allow for sighting down the factory iron sights as mounted to the barrel, as illustrated in FIG. 5.

Figure 7:
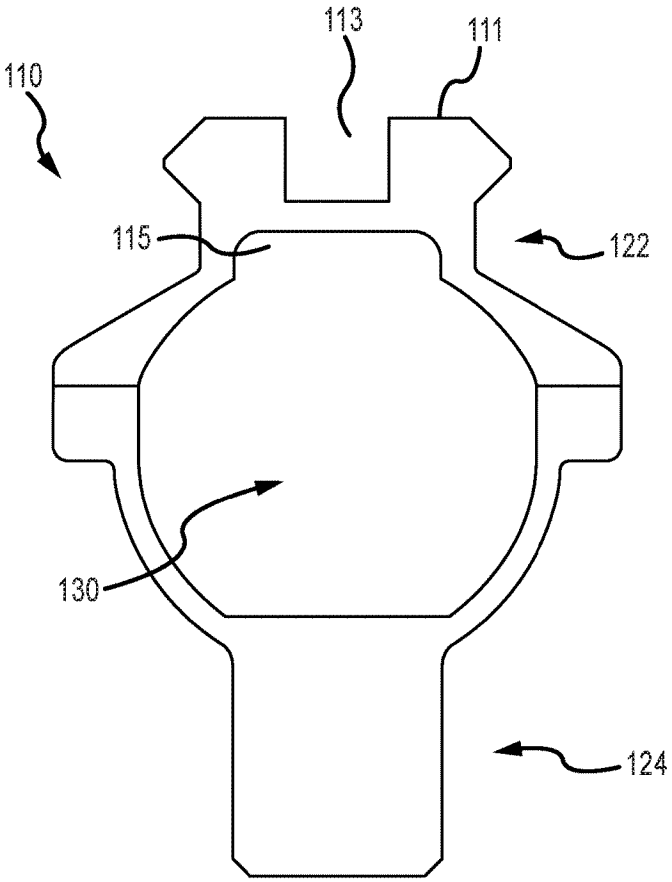
FIG. 7 is a distal end view of the mount in FIG. 5.
Figure 6:
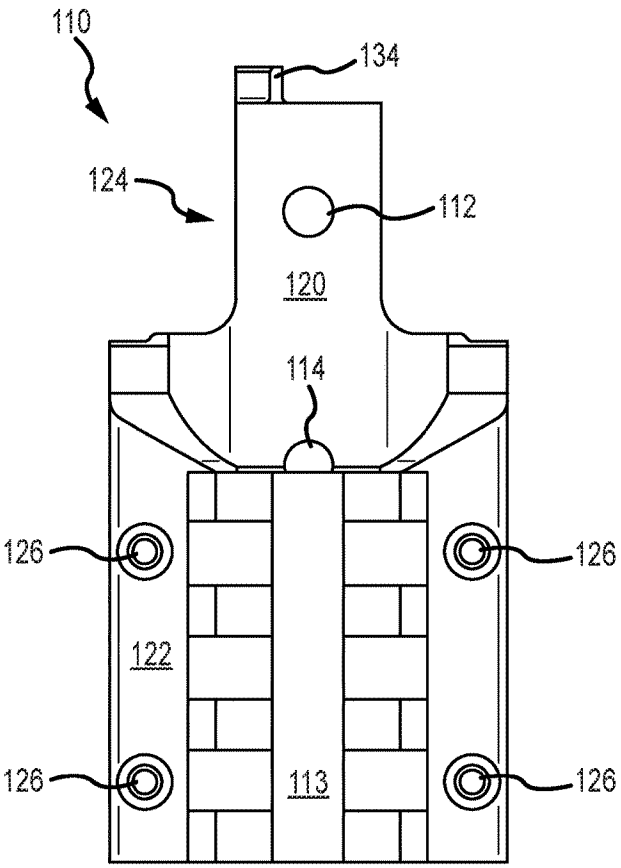
FIG. 6 is a top view of the mount in FIG. 5.
Figure 9:
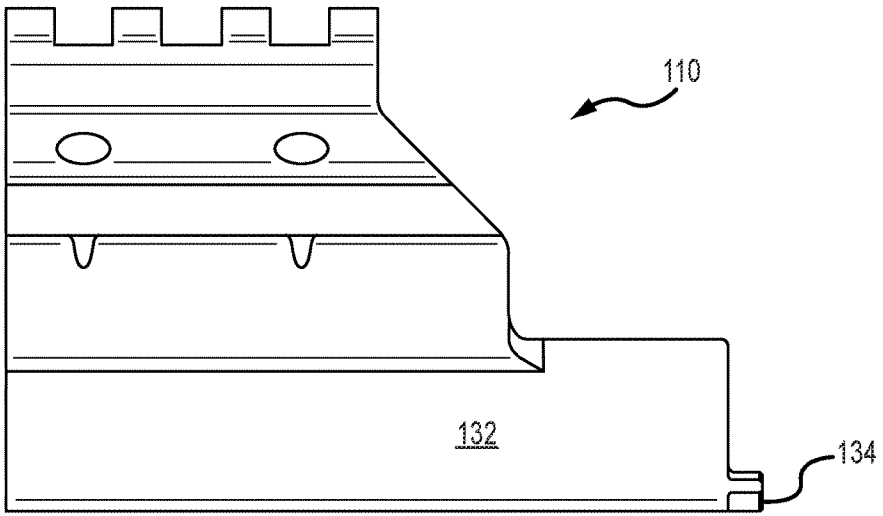
FIG. 9 is a first side view of the mount in FIG. 5.
Figure 8:
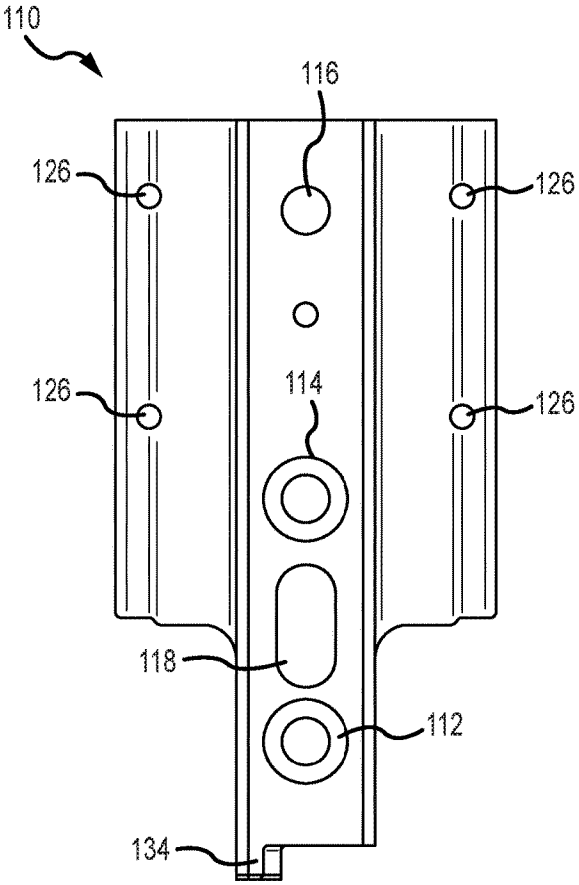
FIG. 8 is a bottom view of the mount in FIG. 5.
Figure 11:
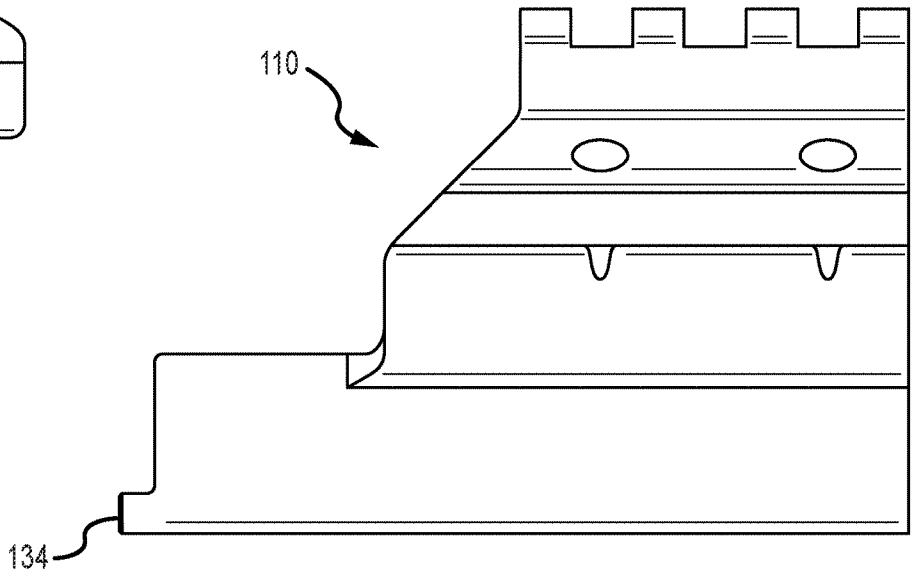
FIG. 11 is a second side view of the mount in FIG. 5.
Figure 10:
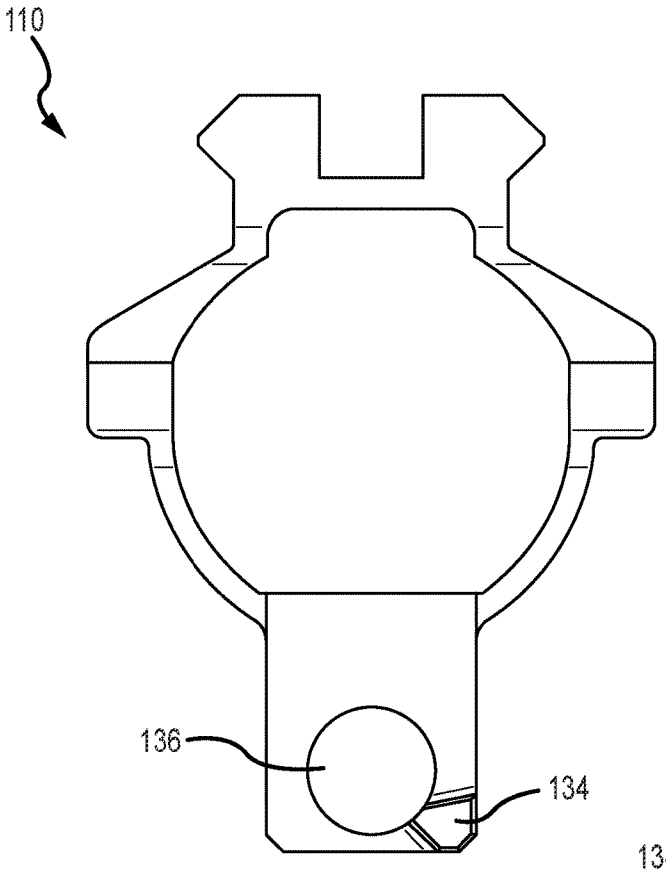
FIG. 10 is a proximal end view of the mount in FIG. 5.
Figure 12:
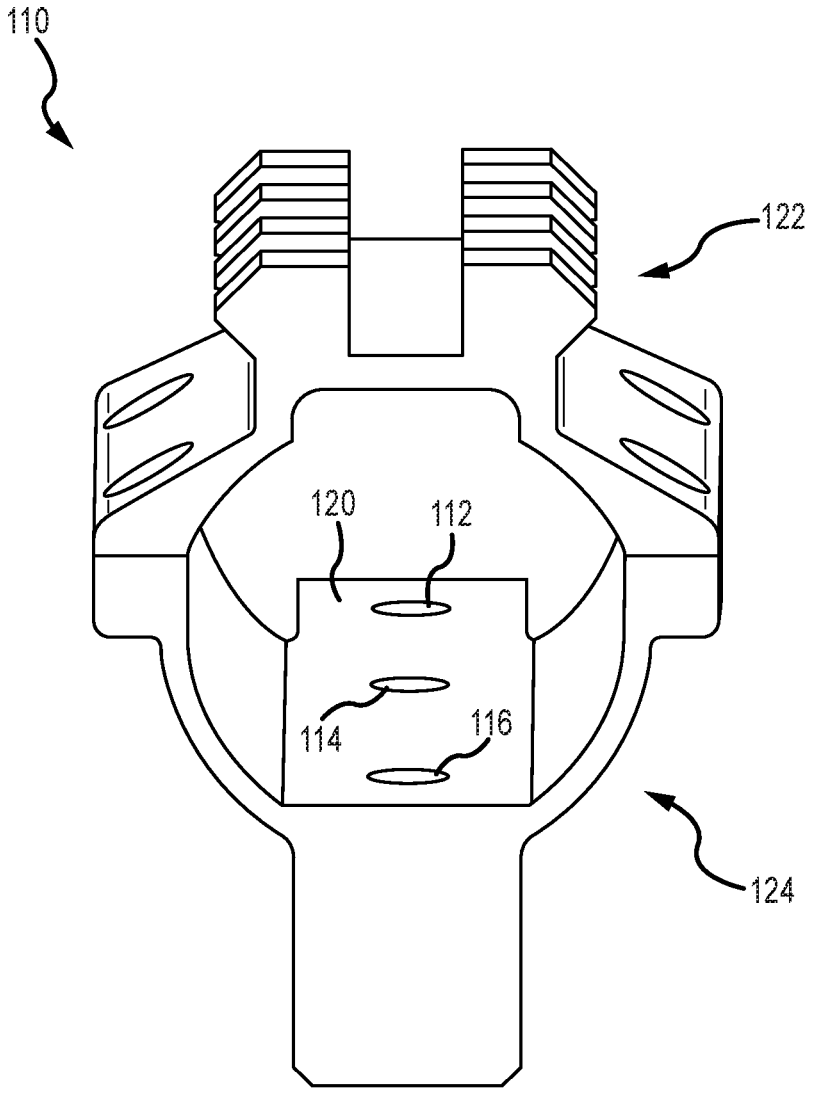
FIG. 12 is an end perspective view of the mount in FIG. 5.
Figure 13:
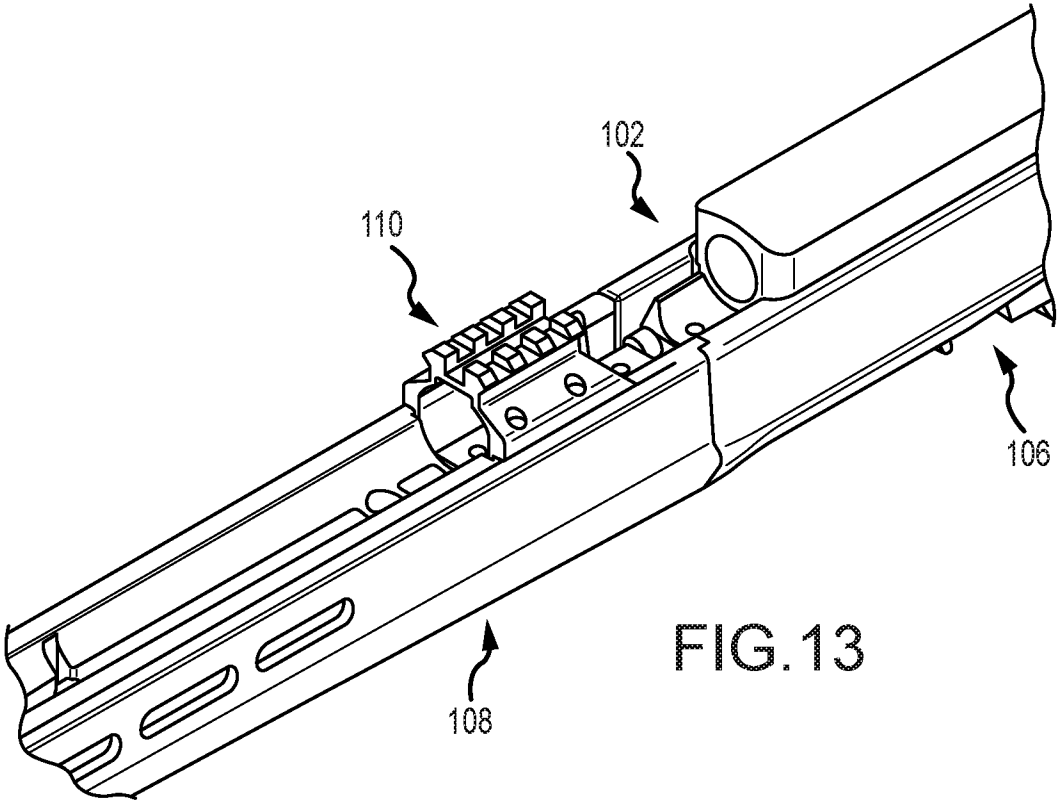
FIG. 13 is a detailed view of some components of the assembly in FIG. 1.

In some embodiments, and as most clearly illustrated in FIG. 7, the accessory mount 110, 210 may include a recess 115 shaped and positioned so as to provide a gap between the barrel 104, 204 and the accessory mount 110, 210, to allow for variances in the barrel 104, 204. The recess 115 may be a portion of the recess 130 or passage. The recess 115 may also prevent surface wear from the accessory mount 110, 210 potentially clamping or hitting against another portion of the barrel 104, 204.

In some embodiments, the height of the accessory interface 111 is selected to match a standard receiver rail height (similar to AR-15 handguard rails matching with the receiver making essentially one continuous rail). In some embodiments, the recess 115 and gap are provided so as to accommodate different barrel types and/or barrel manufacturing inconsistencies. In some embodiments, the recess 115 and gap are provided so as to enable iron sight compatibility. In some embodiments, the recess 115 and gap are provided to ensure a matching rail height for inline sighting systems or rail-mounted backup sights.

In some embodiments, the accessory mount 210 is shaped to minimize contact with the barrel 104, 204. For example, as illustrated in FIGS. 14-21, the accessory mount 210 may not completely encircle the barrel 104, 204, but may instead have a substantially C-shape, so as to only partially encircle the barrel 104, 204. Those skilled in the art will readily recognize that this feature may apply to both tapered and bull or straight barrels 104, 204. In some embodiments, the accessory interface 111 is configured to align a scope to a night vision accessory positioned in front of or behind the accessory mount 110, 210. In some embodiments, the accessory interface 111 may be an interface for a night vision device, and a scope may be positioned behind the accessory mount 110.

In some embodiments, the accessory mount 110, 210 is configured to function with more than one barrel type. In some embodiments, the accessory mount 110, 210 is configured to function with both a straight barrel 204 and a tapered barrel 104. In some embodiments, the accessory mount 110, 210 is configured to function with a firearm 100, 200 having a reversible barrel tray 109 (see e.g. FIG. 1 and FIG. 15).

Figure 22:
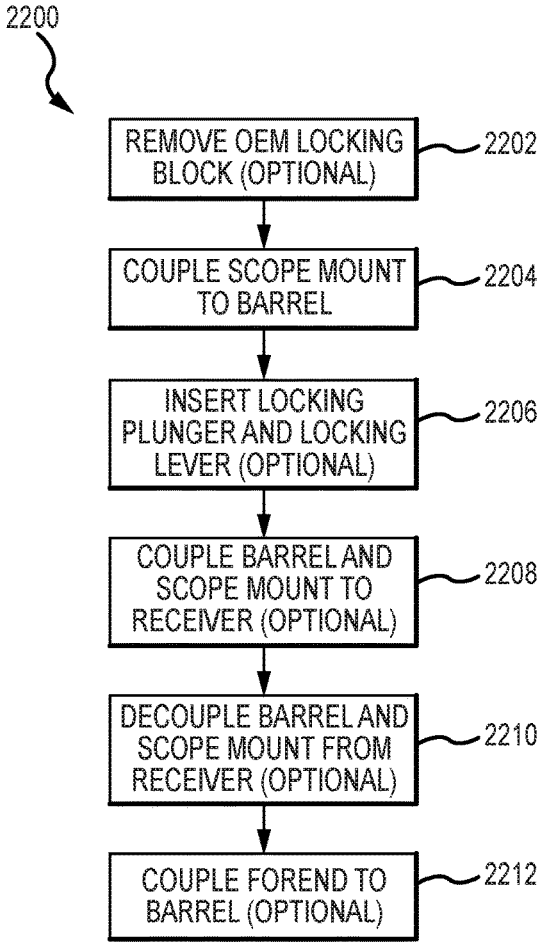
FIG. 22 is a flowchart of an exemplary method.

Turning now to FIG. 22, a method 2200 of modifying a take-down rifle described herein may include removing 2202 an OEM locking block from the barrel. Removing 2202 may include removing at least one threaded fastener coupling the OEM locking block to a threaded recess in the barrel. The method 2200 may include coupling 2204 a scope mount (e.g. accessory mount 110, 210 previously described herein) to the barrel by causing at least one threaded fastener to engage a threaded recess in the barrel, wherein the threaded recess is configured to engage a threaded fastener for attaching an OEM locking block. The method 2200 may also include at least partially inserting a locking plunger and a locking lever in a block in the scope mount. The method 2200 may be achieved using an OEM Ruger 10/22 takedown rifle and the accessory mount 110, 210 previously described herein with reference to FIGS. 1-21.

The method 2200 may also include coupling 2208 the barrel and scope mount to a receiver. Coupling 2208 the barrel and scope mount to a receiver may include moving a locking lever positioned at least partially in the block in the scope mount. The method 2200 may also include decoupling 2210 the barrel and scope mount from the receiver by moving the locking lever that is at least partially positioned in the block of the scope mount.

The method 2200 may also include coupling 2212 a forend to the barrel. Coupling 2212 the forend to the barrel may include threading a threaded fastener into a threaded recess in the block of the scope mount. That is, the method 2200 may include coupling a forend to the scope mount, such as by using a rotatable fastener. Coupling 2212 a forend to the barrel may include adjusting a bedding or barrel tray in the forend as described in commonly assigned U.S. Pat. No. 9,322,611, issued on Apr. 26, 2016, to Barfoot et al., the contents of which are fully incorporated herein by reference.

Figure 23:
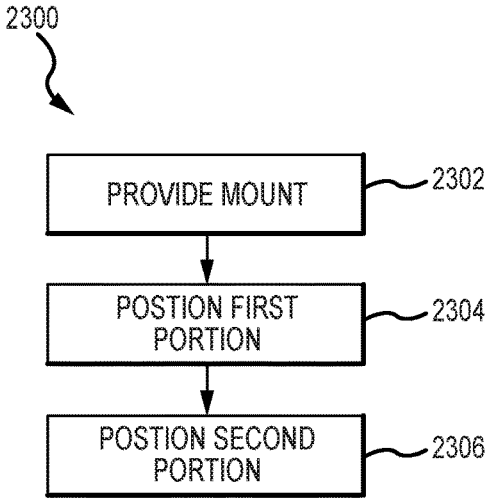
FIG. 23 is a flowchart of an exemplary method.

Turning now to FIG. 23, a no-gunsmithing method 2300 of attaching a firearm accessory mount to a take-down rifle is described. The method 2300 includes providing 2302 a no-gunsmithing mount, the mount having a first portion having an accessory interface, and a second portion opposing the first portion, the second portion having a locking block with a proximal end and a distal end, the proximal end shaped and positioned to engage a receiver assembly of the take-down rifle, wherein at least one of the first portion or the second portion has a barrel engagement surface. The method 2300 may include positioning 2304 the first portion partially about a barrel of the take-down rifle. The method 2300 may also include positioning 2306 the second portion partially about the barrel. The method 2300 may be achieved using an OEM Ruger 10/22 takedown rifle and the accessory mount 110, 210 previously described herein with reference to FIGS. 1-21.

The terms and expressions employed herein are used as terms and expressions of description and not of limitation, and there is no intention, in the use of such terms and expressions, of excluding any equivalents of the features shown and described or portions thereof. In addition, having described certain embodiments, it will be apparent to those of ordinary skill in the art that other embodiments incorporating the concepts disclosed herein may be used without departing from the spirit and scope of the disclosure. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of an actuator should be understood to encompass disclosure of the act of actuating—whether explicitly discussed or not—and, conversely, were there only disclosure of the act of actuating, such a disclosure should be understood to encompass disclosure of an actuating mechanism. Such changes and alternative terms are to be understood to be explicitly included in the description.

The previous description of the disclosed embodiments and examples is provided to enable any person skilled in the art to make or use the present disclosure as defined by the claims. Thus, the present disclosure is not intended to be limited to the examples disclosed herein. Various modifications to these embodiments will be readily apparent to those skilled in the art, and the generic principles defined herein may be applied to other embodiments without departing from the spirit or scope of the invention as claimed.

What is claimed is:

1. A firearm accessory mount for a take-down rifle, comprising:

a first portion having an accessory interface; and a second portion opposing the first portion, the second portion having a locking block with a proximal end and a distal end, the proximal end having a longitudinal tab and the proximal end shaped and positioned to engage a receiver assembly of the take-down rifle; wherein at least one of the first portion or the second portion has a non-threaded barrel engagement surface.

2. The mount of claim 1, wherein:

the first portion is shaped to partially encircle a barrel of the take-down rifle; and the second portion is shaped to partially encircle the barrel.

3. The mount of claim 2, wherein:

the locking block has at least one of a first recess for receiving a locking plunger or a second recess for receiving a locking lever.

4. The mount of claim 1, wherein:

the locking block has at least one of a first recess for receiving a locking plunger or a second recess for receiving a locking lever.

5. The mount of claim 1, wherein:

the first portion is removably couplable to the second portion.

6. The mount of claim 5, wherein:

the first portion is removably coupled to the second portion, whereby the first and second portions are shaped to encircle the barrel.

7. The mount of claim 1, further comprising:

a first fastener removably coupling the locking block to the barrel of the firearm.

8. The mount of claim 7, further comprising:

a second fastener removably coupling the first portion to the second portion.

9. The mount of claim 7, wherein:

the first fastener is positioned more proximal to the proximal end than to the distal end.

10. The mount of claim 1, further comprising:

a plurality of fasteners for coupling the first portion and the locking block to the barrel.

11. A method of attaching a firearm accessory mount to a take-down rifle, comprising:

providing a mount, the mount having a first portion having an accessory interface, and a second portion opposing the first portion, the second portion having a locking block with a proximal end and a distal end, the proximal end having a longitudinal tab and the proximal end shaped and positioned to engage a receiver assembly of the take-down rifle, wherein at least one of the first portion or the second portion has a barrel engagement surface;

positioning the first portion partially about a non-threaded portion of a barrel of the take-down rifle; and positioning the second portion partially about the barrel.

12. The method of claim 11, further comprising at least one of:

moving a locking lever proximally or distally to adjust a position of a locking plunger proximally or distally, the locking plunger movable in a first recess of the locking lever, and the locking lever movable in a second recess of the locking lever.

13. The method of claim 11, wherein:

the locking block has a first recess for receiving a locking plunger and a second recess for receiving a locking lever; and the method further comprises sliding the locking lever proximally or distally in the second recess to move the locking plunger.

14. The method of claim 11, further comprising:

removably coupling the first portion to the second portion.

15. The method of claim 14, further comprising:

causing the first and second portions to encircle the barrel.

16. The method of claim 11, further comprising:

removably coupling the locking block to the barrel of the firearm.

17. The method of claim 16, further comprising:

removably coupling the first portion to the second portion.

18. The method of claim 16, further comprising:

the removably coupling the locking block comprises using a first fastener positioned more proximal to the proximal end than to the distal end.

19. The method of claim 11, further comprising:

using a plurality of fasteners to couple the first portion and the locking block to the barrel.

20. The method of claim 11, further comprising:

causing the locking block to engage a receiver assembly of the take-down rifle to align the mount to the receiver.

21. A firearm accessory mount for a take-down rifle, comprising:

a first portion having an accessory interface; and a second portion opposing the first portion, the second portion having a locking block with a proximal end and a distal end, the proximal end shaped and positioned to engage a receiver assembly of the take-down rifle, the locking block further having at least one of a first recess for receiving a locking plunger or a second recess for receiving a locking lever; wherein at least one of the first portion or the second portion has a barrel engagement surface.

22. The mount of claim 21, wherein:

the first portion is shaped to partially encircle a barrel of the take-down rifle; and the second portion is shaped to partially encircle the barrel.

23. The mount of claim 21, wherein:

the proximal end of the locking block comprises a tab for engaging the receiver assembly.

24. The mount of claim 21, wherein:

the first portion is removably couplable to the second portion.

25. The mount of claim 24, wherein:

the first portion is removably coupled to the second portion, whereby the first and second portions are shaped to encircle the barrel.

26. The mount of claim 21, further comprising:

a first fastener removably coupling the locking block to the barrel of the firearm.

27. The mount of claim 26, further comprising:

a second fastener removably coupling the first portion to the second portion.

28. The mount of claim 26, wherein:

the locking block has a tab positioned on the proximal end; and the first fastener is positioned more proximal to the proximal end than to the distal end.

29. The mount of claim 21, further comprising:

a plurality of fasteners for coupling the first portion and the locking block to the barrel.

* * * * *